US005871069A

United States Patent [19]

Carmitchel

[11] Patent Number: 5,871,069

[45] Date of Patent: Feb. 16, 1999

[54] COMBINATION MOTORIZED AND MANUAL DRIVE FOR LIFTS

[76] Inventor: Richard A. Carmitchel, 15610 Honey Creek Rd., Bonner Springs, Kans. 66012

[21] Appl. No.: 15,019

[22] Filed: Jan. 29, 1998

Related U.S. Application Data

[63] Continuation-in-part of Ser. No. 710,865, Sep. 23, 1996.

[51] Int. Cl.[6] ..... B66F 9/06

[52] U.S. Cl. ..... 187/231; 187/233; 187/235; 254/362; 254/365; 254/358

[58] Field of Search ..... 187/231, 233, 187/235; 254/362, 365, 358; 242/394

[56] References Cited

U.S. PATENT DOCUMENTS

| | | | |
|---|---|---|---|
| 467,135 | 1/1892 | Quackenboss | 187/263 |
| 640,088 | 12/1899 | Broughton et al. | 187/231 |
| 1,228,203 | 5/1917 | Germond, Jr. | 187/231 |
| 1,342,982 | 6/1920 | Boehck | 187/231 |
| 1,504,415 | 8/1924 | Barrett et al. | 187/235 |
| 1,512,390 | 10/1924 | Young | 187/235 |
| 2,518,934 | 8/1950 | Renner et al. | 242/394 |
| 2,573,868 | 11/1951 | Newell | 242/394 |
| 2,895,567 | 7/1959 | Hall | 187/231 |
| 3,026,744 | 3/1962 | Rouse | 74/625 |
| 3,120,845 | 2/1964 | Horner | 74/625 |
| 3,385,401 | 5/1968 | Campbell et al. | 187/222 |
| 3,744,760 | 7/1973 | Uher | 254/351 |
| 4,012,002 | 3/1977 | McDonald et al. | 242/390.8 |
| 4,085,629 | 4/1978 | Fogarollo | 74/625 |
| 4,269,285 | 5/1981 | Ohkoshi et al. | 187/270 |
| 4,456,227 | 6/1984 | Notenboom | 254/350 |
| 4,580,463 | 4/1986 | Allouche et al. | 74/625 |
| 5,124,440 | 6/1992 | Bixby | 424/186.1 |

FOREIGN PATENT DOCUMENTS

| | | | |
|---|---|---|---|
| 200818 | 10/1924 | United Kingdom | 187/235 |

*Primary Examiner*—Karen M. Young
*Assistant Examiner*—Thuy V. Tran
*Attorney, Agent, or Firm*—Chase & Yakimo, L.C.

[57] ABSTRACT

A power option is provided for a manually-operated material lift that employs a telescoping mast system which is extended or retracted by a winch. In one embodiment a reversible electric motor is connected to the winch via two-way reduction gearing that remains in the drive train during manual operation and requires no clutches or disconnect means. In a second embodiment a crankshaft that operates the winch is provided with slide couplings that either engage the manual operating handles or release the handles and engage the motorized drive. The power option is initiated by selecting the position of a reversing switch that controls the motor, and closing an on/off switch which energizes the motor for rotation in the selected direction. When the on/off switch is open, the lift may be manually operated in the conventional manner.

8 Claims, 8 Drawing Sheets

Fig. 5
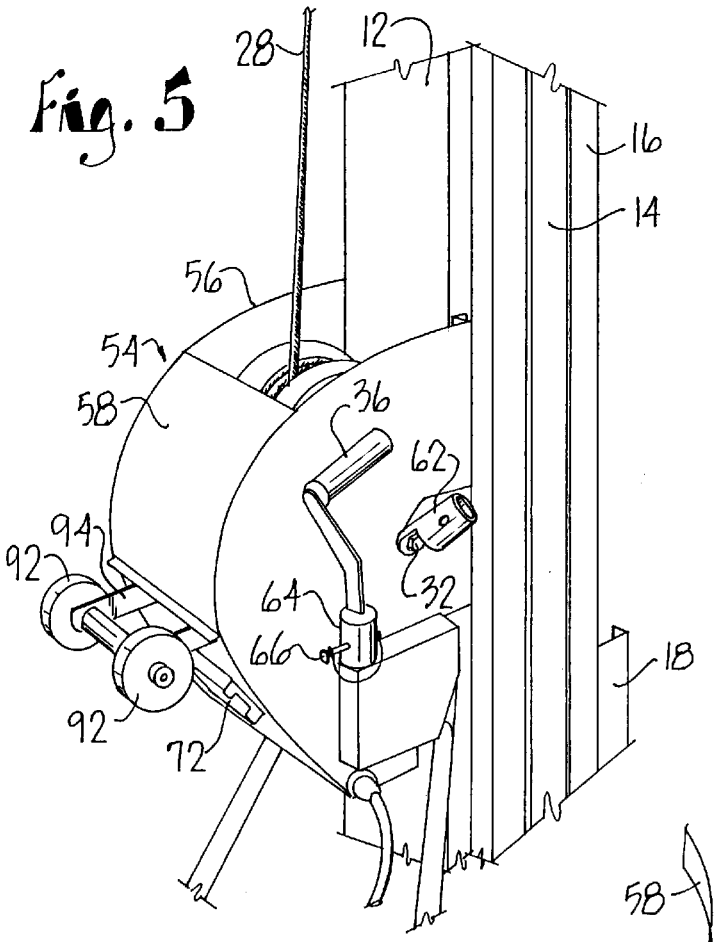
Fig. 6
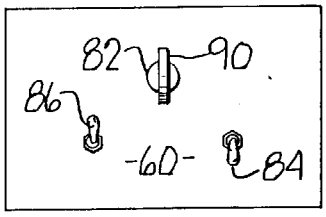
Fig. 7
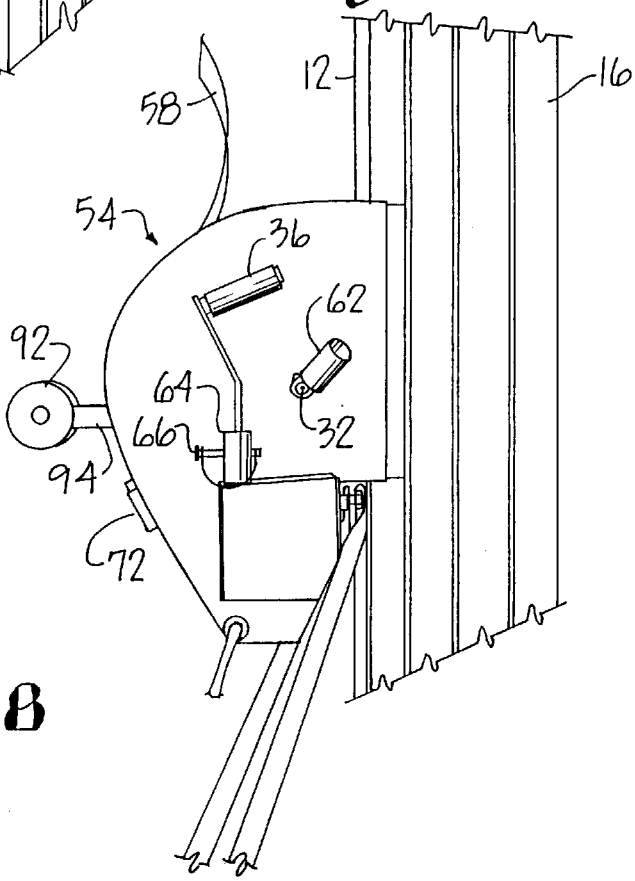
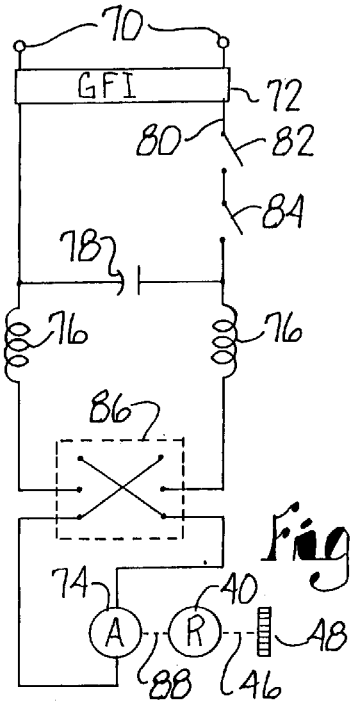
Fig. 8

COMBINATION MOTORIZED AND MANUAL DRIVE FOR LIFTS

CROSS-REFERENCE

This application is a continuation-in-part of application Ser. No. 08/710,865, filed Sep. 23, 1996.

BACKGROUND OF THE INVENTION

This invention relates to improvements in manually-operated material lifts that employ telescoping mast systems and, in particular, to a power option for such lifts which does not interfere with manual operation thereof.

Material lifts for construction and industrial applications in widespread use at the present time employ a telescoping mast system that enables a supported load to be raised to a desired level or lowered from a stored position for use or transport to another location. These lifts are typically manually operated through the use of a winch which either takes up or feeds out a cable that either extends the mast sections or retracts them as desired. Although lifts of this type have been proven to be highly useful and satisfactory, manual operation is a limitation on their utilization and the speed at which loads can be handled.

SUMMARY OF THE INVENTION

It is, therefore, the primary object of the present invention to provide a power option for material lifts of the type employing telescoping mast systems operated by a winch, wherein the winch may be driven by a reversible electric motor without interfering with normal manual operation.

In accordance with a first embodiment of the invention, it is also an important object to provide such a power option which does not require the use of clutches or other means to disconnect the motor from the winch during manual operation, thereby providing a simple power option at minimum cost.

Another important object is to provide a simple power option as aforesaid in which the electric motor, when selected for operation, drives the winch via two-way reduction gearing which does not lock up when manual operation is selected and the transmission parts are required to rotate with the motor de-energized.

In accordance with a second embodiment of the invention, it is also an important object to provide a power option for material lifts of the type employing telescoping mast systems operated by a winch, wherein the operator may selectively couple the winch with a reversible electric motor or uncouple the winch therefrom for normal manual operation. This is accomplished by providing a slide coupling which is associated with a winch operating handle and which may be easily manipulated to select either the motor-driven option or normal manual operation of the winch.

Still another important object of both embodiments of the invention is to provide a power option in which, when electric motor drive is selected, the winch is driven at a higher speed than during manual operation in order to increase the efficiency of the lift.

Yet another important object is to provide a power option for lifts of this type utilizing an electric motor and reduction gear transmission mounted on the stationary mast support section of the mast system, a sprocket and chain drive interconnecting the transmission and the winch, and a control panel having on/off and reversing switches for controlling the motor, all of which is enclosed in a housing mounted on the support section for convenient access by the operator.

Furthermore, objects of this invention include additional operating features, i.e., the provision of a door on the housing to permit access to the control panel, the provision of a key-operated switch to preclude use of the power option other than by authorized personnel, and in one embodiment a removable crank handle for the winch which may be conveniently retained on the housing in a stored position during motorized operation.

Other objects will become apparent as the detailed description proceeds.

BRIEF DESCRIPTION OF THE DRAWINGS

FIG. 5 is a perspective view of the apparatus shown in FIG. 3 as seen from the right side of FIG. 3, the housing being added and a crank handle being shown stored.

FIG. 6 is a detail of the control panel as seen in plan when the access door is open as in FIG. 7.

FIG. 7 is an enlarged, fragmentary, side elevational view of the lift apparatus shown in FIG. 2, with the access door open.

FIG. 8 is a schematic diagram of the control circuit and drive components.

DETAILED DESCRIPTION

Figure 1:
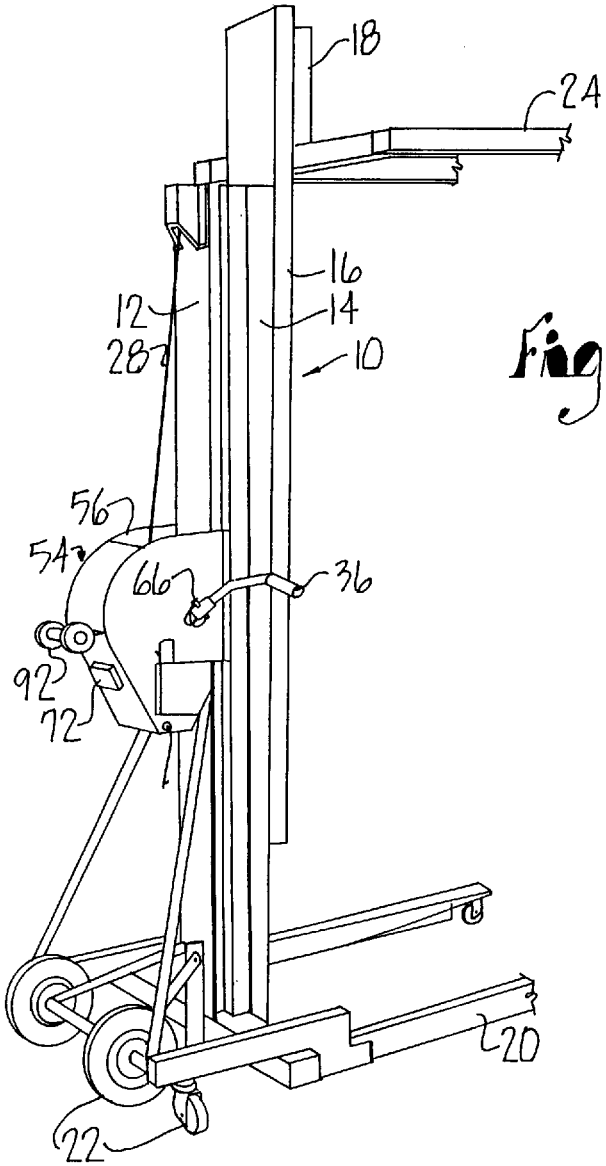
FIG. 1 is a perspective view of the first embodiment of a material lift incorporating the improvements of the present invention, the telescoping mast assembly being shown partially extended.

A material lift shown in FIGS. 1–5, 7 and 9–11 is of the type employing a four-section telescoping mast assembly 10 having a stationary support section 12 and three extendible mast sections 14, 16 and 18. The bottom of the support section 12 is secured to an underlying base 20 having wheels and castors 22 as shown to permit the lift to be readily moved from location to location. Absent the improvements of the present invention to be discussed, lifts of the type illustrated are exclusively manually operated and are manufactured by Genie Industries of Redmond, Wash., U.S.A. and sold under the trademark SUPERLIFT.

Figure 2:
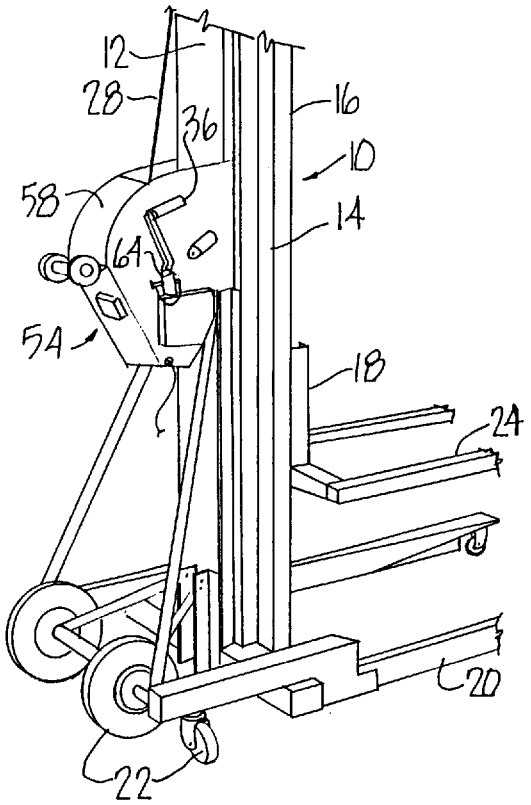
FIG. 2 is a fragmentary, perspective view similar to FIG. 1 but showing the mast assembly fully retracted.
Figure 9:
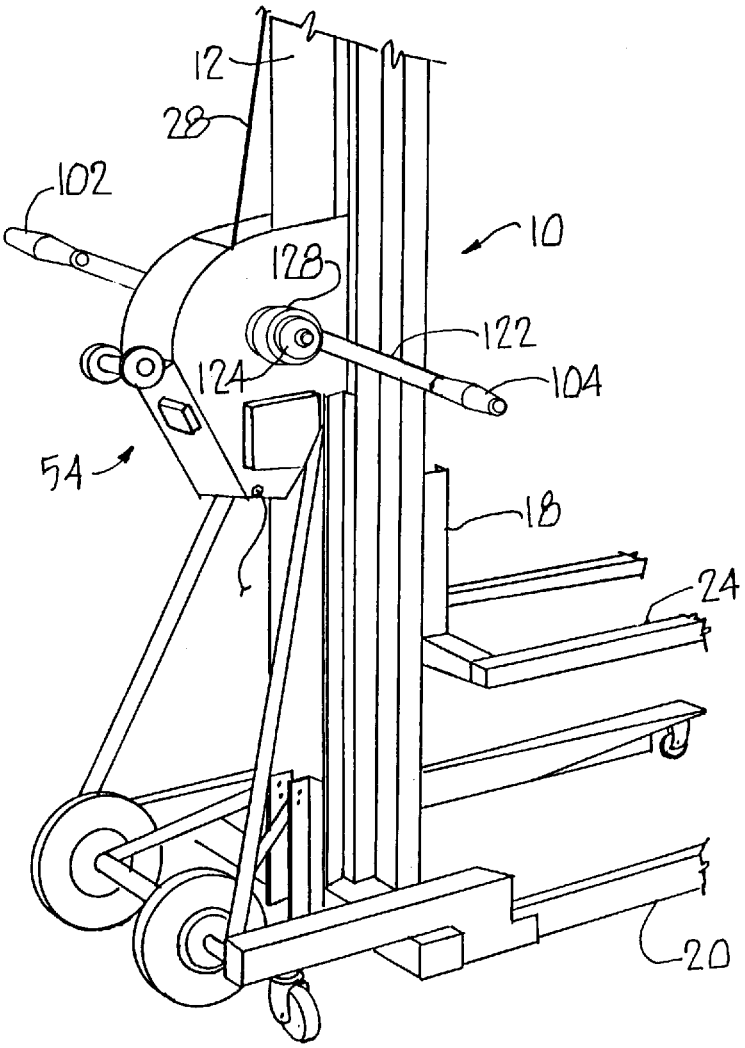
FIG. 9 is a fragmentary, perspective view similar to FIG. 2 showing the second embodiment of a material lift incorporating the improvements of the present invention, the telescoping mast assembly being shown fully retracted.
Figure 10:
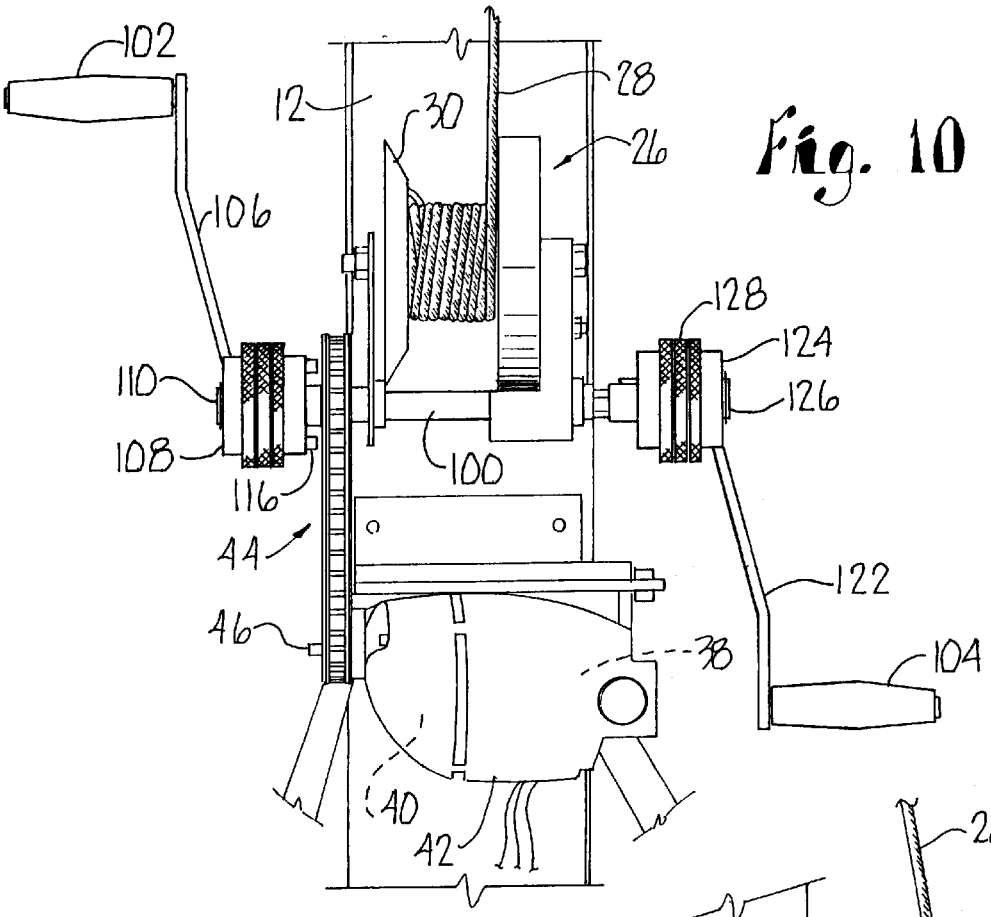
FIG. 10 is an enlarged, fragmentary front view of the mast assembly of FIG. 9 showing the support section and drive components of the second embodiment mounted thereon, the housing being removed for clarity.
Figure 11:
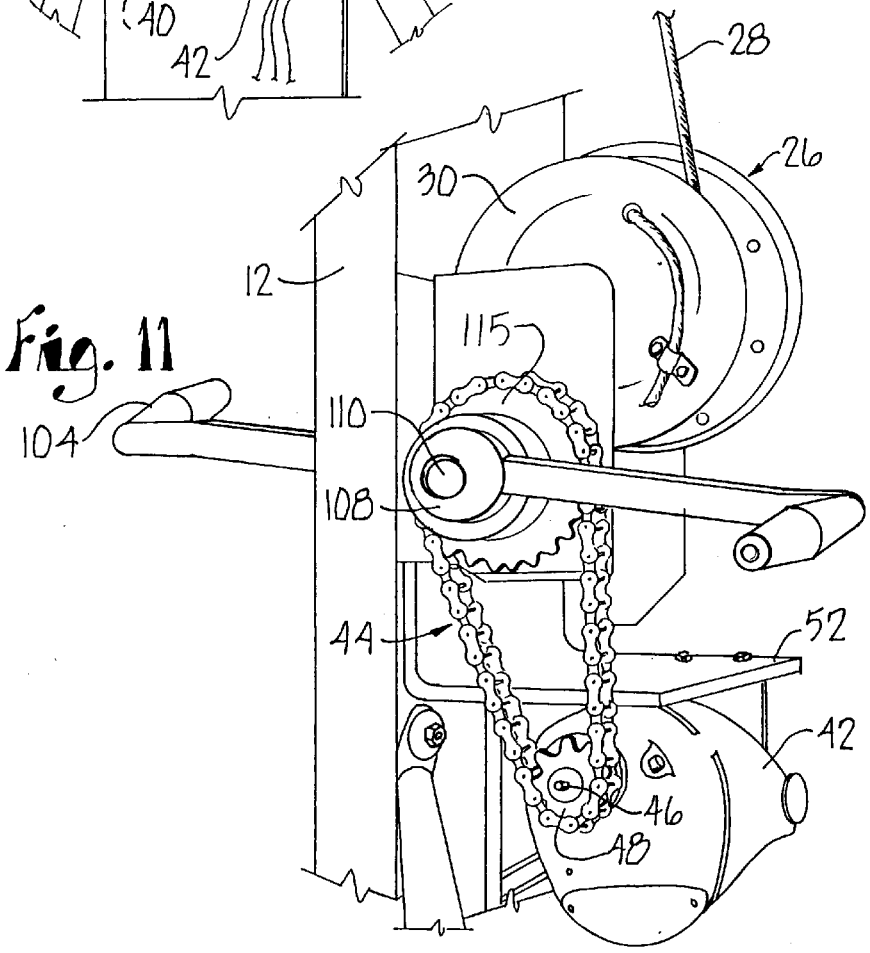
FIG. 11 is a further enlarged, perspective view of the components shown in FIG. 10 as seen from the left side of FIG. 10.

In the particular lift illustrated employing the four-section telescoping mast assembly 10, the outermost lifting section 18 is provided with an outwardly extending fork 24 for supporting a load (not shown) to be raised or lowered by a winch 26 best seen in FIGS. 3, 4, 10 and 11. The mast sections are interlocked but slide longitudinally (vertically) with respect to one another in response to the takeup or release of the winch cable 28 which is connected to the movable mast sections 14, 16 and 18 by an internal pulley system (not shown) that causes the outermost section 18 to extend first, followed by sections 16 and 14 in sequence in the conventional manner. In FIG. 1, mast section 18 is shown fully extended and section 16 is partially extended. In FIGS. 2 and 9, the winch cable 28 is released and all sections are fully retracted.

Figure 3:
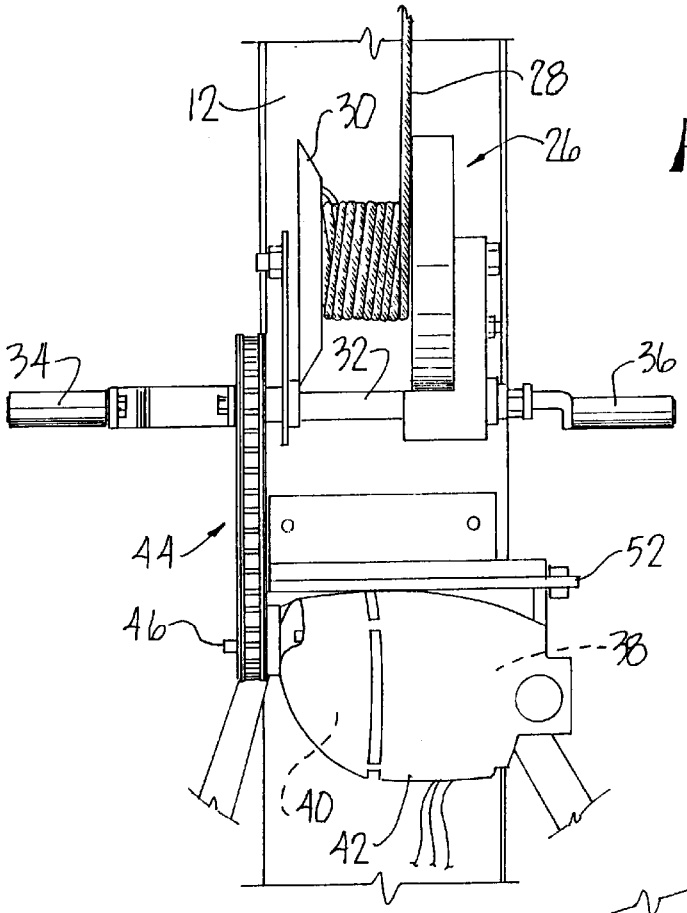
FIG. 3 is an enlarged, fragmentary, front view of the mast assembly showing the support section and drive components mounted thereon, the housing being removed for clarity.
Figure 4:
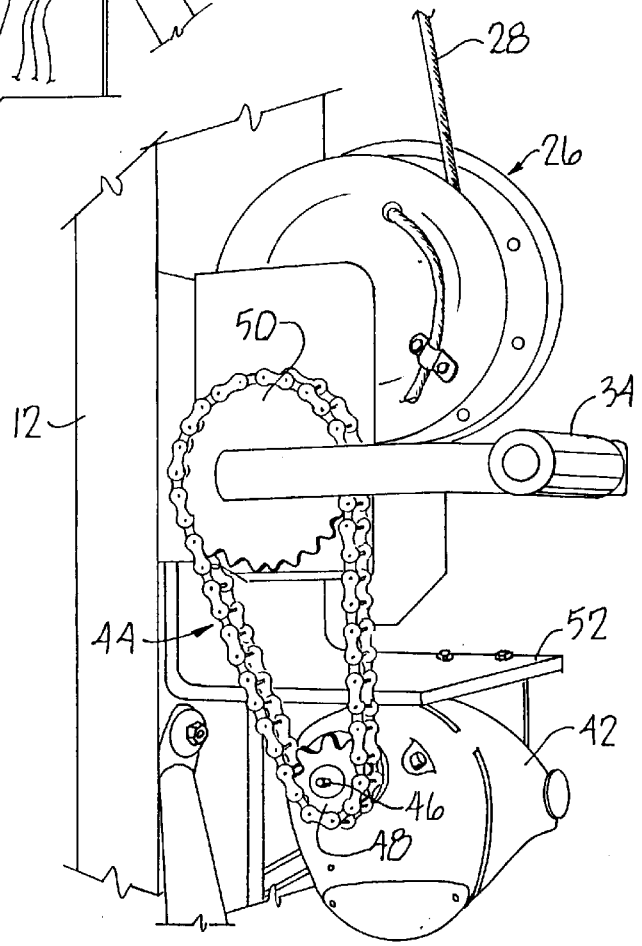
FIG. 4 is a further enlarged, perspective view of the components shown in FIG. 3 as seen from the left side of FIG. 3.

The first embodiment of the present invention is shown in FIGS. 1–5 and 7. Referring to FIGS. 3 and 4, the winch 26 is mounted on the front of the support section 12 and includes a drum 30 upon which the cable 28 is wound, and a crankshaft 32 having crank handles 34 and 36 on its respective ends for manually rotating the crankshaft 32 to, in turn, drive the drum 30 through appropriate gearing (not visible). The present invention adds a power option and includes, as major components thereof, a power unit comprising a reversible electric motor 38 and reduction gear transmission 40 in a case 42, a sprocket and chain drive 44 from the transmission 40 to the crankshaft 32, and control circuitry for the motor 38 shown in FIG. 8. These components are fully described below.

The motor 38 (typically ¼ hp) and reduction gear transmission 40 in the preferred embodiment illustrated are components utilized in standard half-inch drills such as for example, a ½" spade handle drill manufactured by Black & Decker, Inc. of Hampstead, Md., U.S.A. The handle is removed from the case 42, and the chuck on drive shaft 46 is replaced by a sprocket 48 of drive 44. A larger sprocket 50 on crankshaft 32 provides an additional 4:1 gear reduction so that crankshaft 32, when driven by motor 38, turns at 100 r.p.m. This is approximately twice the speed that crankshaft 32 would be driven by hand using handles 34 and 36. The case 42 containing motor 38 and transmission 40 is conveniently mounted below crankshaft 32 by an angle bracket 52 secured to support section 12.

As seen in FIGS. 1, 2, 5 and 7, a housing 54 projects forwardly from support section 12 and encases the case 42, drive 44 and winch 26 except for an open top 56 thereof which provides clearance for the winch cable 28. The housing 54 may be of sheet metal construction and is provided with an access door 58 swingable to an open or raised position as seen in FIG. 7 to provide the operator with access to a horizontal control panel 60 (FIG. 6) within housing 54.

For convenience during motorized operation, the crank handles 34 and 36 may be disconnected from crankshaft 32 and stored. This is illustrated for handle 36 by a comparison of FIGS. 1 and 2, the stored position of FIG. 2 being shown in detail in FIGS. 5 and 7. The end of the crankshaft 32 seen in FIGS. 5 and 7 is provided with a socket 62 from which handle 36 is removed and replaced in a mating socket 64 on the side of housing 54. Socket 64 extends vertically so that handle 36 is held in an upright position against housing 54, the handle 36 being retained in such stored position by a cross pin 66 through socket 64 and a cross hole (not shown) in the arm of handle 36. When reinstalled on the crankshaft, handle 36 is secured in like manner by the cross pin 66 (FIG. 1). This feature is not shown in FIGS. 3 and 4.

The control circuit (FIG. 8) is supplied with 110 volt alternating current at terminals 70 and is protected by a ground fault interrupter 72 (the grounding lead is omitted for simplicity). The motor 38 includes an armature 74 and field windings 76, and a parallel capacitor 78. From the GFI 72, the ungrounded lead 80 has a key-operated switch 82 and an on/off switch 84 imposed in series therein. The armature 74 and windings 76 are connected to a reversing switch 86 that controls the up/down movement of the mast assembly. The motor armature 74 has an output shaft 88 connected to the reduction gear transmission 40 which turns the drive shaft 46 at 400 r.p.m.

The switches described above with reference to FIG. 8 are identified in FIG. 6 with the same reference numerals. A key 90 is shown inserted in the key-operated switch 82. The GFI 72 may be mounted on the front of the housing 54 to also provide a convenience outlet for other electric tools or lights. A pair of rollers 92 are mounted on fingers 94 projecting forwardly from housing 54 to facilitate movement of the apparatus along the floor when tilted over for movement to another working location.

In use, an authorized operator raises the access door 58 and inserts the key 90 to close switch 82 and condition the control circuit for operation. The position of the reversing switch 86 is first selected in accordance with whether up or down movement (extension or retraction) of the mast is desired. Then the on/off switch 84 is closed to energize motor 38 until the fork 24 reaches or approaches the desired level. The operator may then elect to open the switch 84 and make a final adjustment in the position of the fork 24 using one or both of the crank handles 34, 36.

During manual operation, either to adjust the height of the fork 24 or to raise or lower the lifting sections 14, 16 and 18 of the mast a substantial distance manually, it should be understood that it is only required that the operator set the switch 84 in the open or off position. The reduction gear Transmission 40 employs meshing spur and pinion gears and thus transfers rotation in the reverse direction from drive shaft 46 to motor output shaft 88 when the winch 26 is manually rotated by crank handles 34 and 36. With the motor 38 de-energized, its armature 74 is rotated manually with the winch 26 but presents a negligible load as compared with the force that is applied to the winch cable 28. Accordingly, no clutches or other means are required to disconnect the motor 38 when manual operation is elected. The selection of the power option or standard manual operation, therefore, merely requires operating the on/off switch 84 to either energize or de-energize the motor.

The second embodiment of the present invention is shown in FIGS. 9–15. Components identical to those illustrated and described above in the first embodiment are designated by the same reference numerals. In this embodiment the drum 30 of winch 26 is driven by rotation of a crankshaft 100 either manually via crank handles 102 and 104 or, upon release of the handles from the crankshaft 100, by the reversible electric motor 38.

With reference to FIGS. 10 and 12–14 in particular, it may be seen that crank handle 102 is on the outer end of an arm 106 that extends from a hub 108 rotatable on the left end 110 of crankshaft 100 as viewed in the figures. A slide coupling in the nature of a collar 112 fits over end 110 and is keyed to the crankshaft 100 for rotation therewith. Key 114 is received by a corresponding keyway in collar 112 but the interfitting parts are sized to permit the collar 112 to shift axially of the crankshaft 100 between an outer position engaging and holding the hub 108 fast to the crankshaft (FIGS. 10, 13 and 14), and an inner position releasing the hub 108 and engaging a driven sprocket 115 spaced inwardly from the end 110 of crankshaft 100. The drive chain of drive 44 is trained around sprocket 115 as in the first embodiment.

Figure 12:
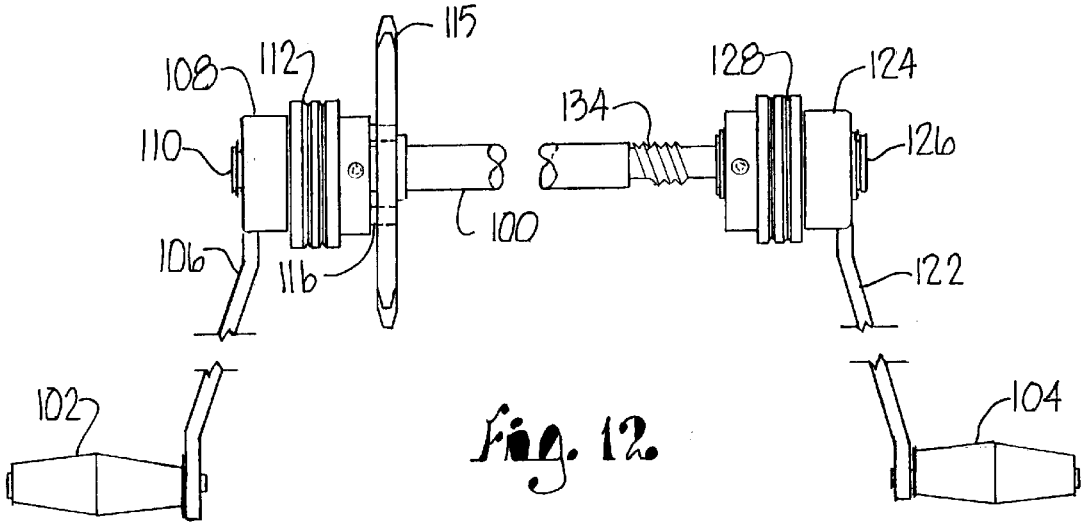
FIG. 12 is a fragmentary, elevational view showing the slide couplings of the second embodiment in their power option positions.
Figure 13:
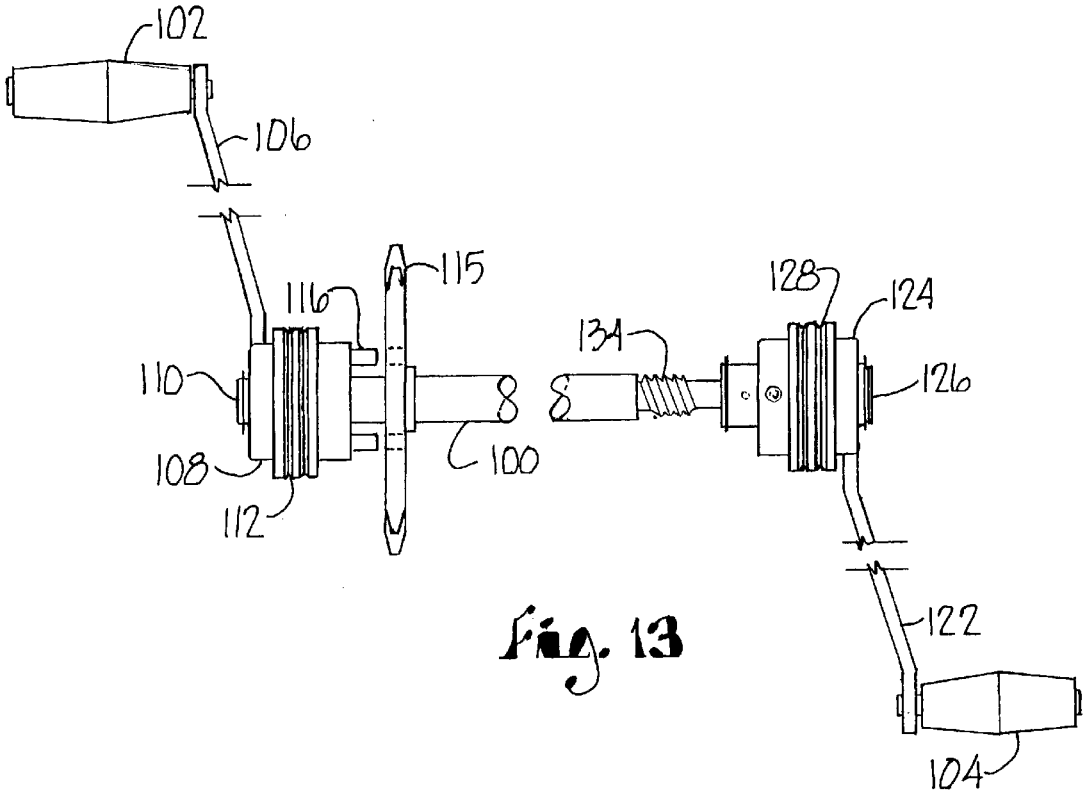
FIG. 13 is a view similar to FIG. 12 but showing the slide couplings shifted to their manual operation positions.
Figure 14:
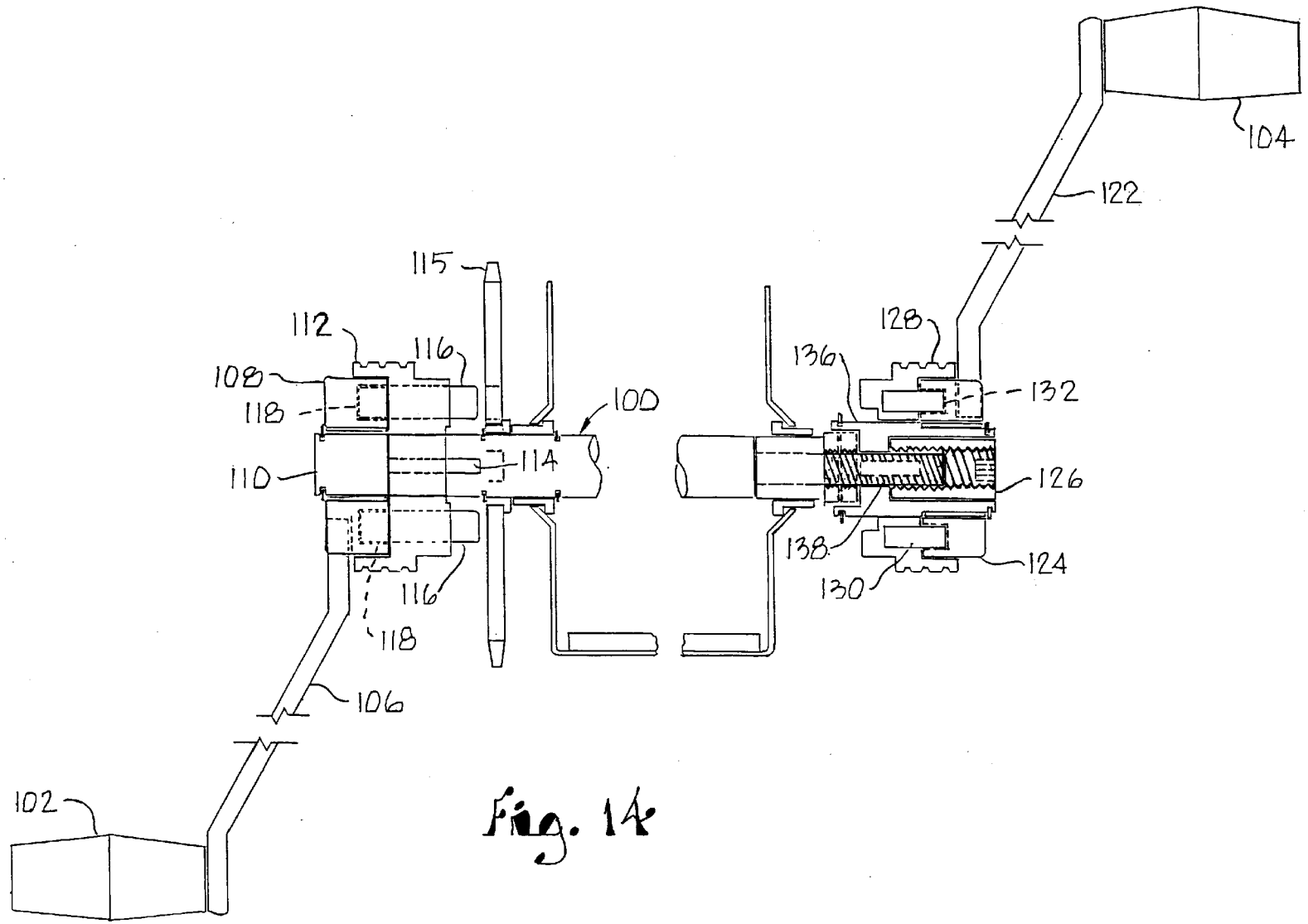
FIG. 14 is an enlarged, fragmentary view, partially in elevation and partially in longitudinal cross-section, showing the slide couplings in their manual operation positions.

Collar 112 carries a pair of double-ended pins 116 which project longitudinally from each side of the collar in parallelism with the axis of crankshaft 100. As seen in FIG. 14, for manual operation the left ends of pins 116 are received within sockets 118 in the inner face of hub 108 thereby positively interconnecting the collar 112 and hub 108 to secure handle 102 to the crankshaft 100. When shifted to the right as illustrated in FIG. 12, the pins 116 are received in corresponding openings 120 (FIG. 15) in sprocket 115 to interconnect the collar and the sprocket so that the drive 44 will rotate the crankshaft 100 upon operation of motor 38. This shifting of coupling collar 112 to the right also disengages the collar from the hub 108 so that the handle 102 is now free of the crankshaft. This is depicted in FIG. 12 where the components are shown in their power option positions with both handles 102 and 104 hanging free of the crankshaft.

Similarly, crank handle 104 is mounted on an arm 122 that extends from a hub 124 that receives the right end 126 of crankshaft 100. A second slide coupling collar 128 is keyed at 129 (FIG. 15) to the right end portion of crankshaft 100 for axial movement between the two positions illustrated in FIGS. 12 and 13. The collar 128 carries a pair of pins 130 (FIG. 15) which are received within corresponding openings 132 in hub 124 to unite these components for manual operation of the winch 26. For motorized operation, the collar 128 is shifted axially inwardly as seen in FIG. 12 to withdrawal the pins 130 from hub 124 and thereby free the handle 104 from the crankshaft 100. To facilitate movement of the two collars 112 and 128 between their operational positions, the outer circumferential surfaces thereof are ribbed as illustrated so they may be readily grasped and shifted by the operator.

Figure 15:
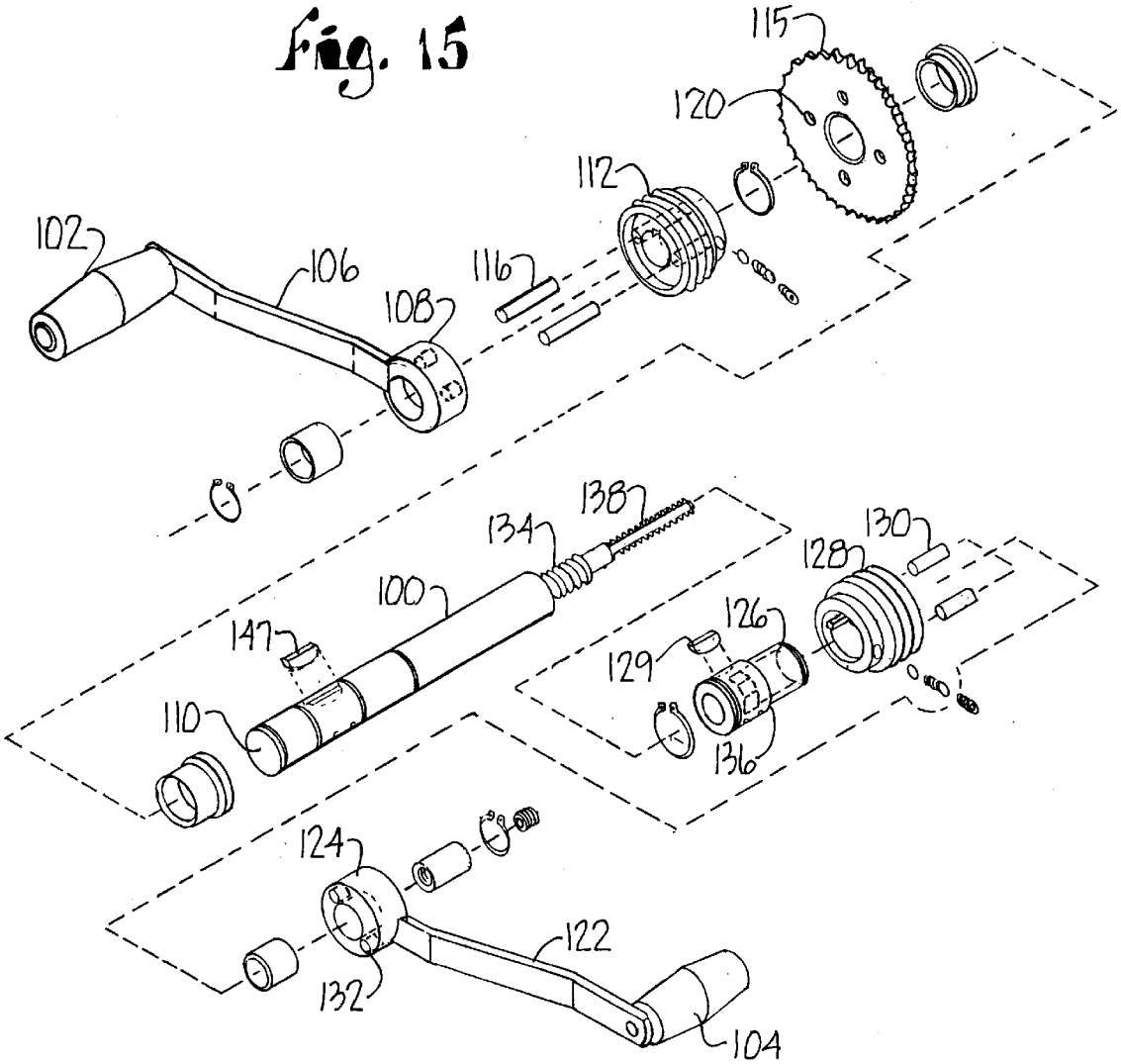
FIG. 15 is an exploded view of the selectively operable drive assembly of FIGS. 12–14 showing the crank handles, slide couplings, driven sprocket, crankshaft and associated components.

It should be understood from FIG. 15 that threads 134 on crankshaft 100 are provided for a gear (not shown) that is part of the conventional gearing from the crankshaft to the drum 30. The right end 126 of crankshaft 100 is presented by a tubular end piece 136 threaded on a reduced shaft portion 138.

Utilization of the second embodiment of the present invention is the same as described above for the first embodiment except that the operator selects the positions of the coupling collars 112 and 128 prior to operation in either mode. Although this requires an additional operational step, an advantage is that the transmission 40 does not transfer rotation in the reverse direction from drive shaft 46 to motor output shaft 88 during manual operation because the drive 44 is disengaged from the crankshaft 100. This permits the use of any type of drive between the electric motor 38 and the crankshaft 100.

Having thus described the invention, what is claimed as new and desired to be secured by letters patent is as follows:

1. In a material lift having a telescoping mast assembly including a stationary support section and at least one lifting section carried by the support section and movable between a lower, retracted position and an upper, extended position, and where a winch is mounted on the support section for raising and lowering the lifting section, the winch having a crankshaft which can be turned to operate the winch and raise and lower the lifting section, the improvement comprising:

a reversible electric motor unit mounted on said support section and having a drive shaft, drive means coupling said drive shaft with a driven member on said crankshaft, a handle on said crankshaft, a selectively operable coupling rotatable with said crankshaft and movable between a first position engaging said handle for joining the handle to the crankshaft for manual operation of the winch, and a second position engaging said driven member for joining the driven member to the crankshaft for motorized operation of the winch, and a control circuit connected to said motor and having on/off switch means for selecting motorized operation or manual operation of the winch, and reversing switch means for selecting upward or downward movement of the lifting section during motorized operation, whereby to provide the option of motorized drive for the lift.

2. The improvement as claimed in claim 1, wherein said handle has a hub on said crankshaft spaced from said driven member, and said coupling is disposed between said hub and said driven member for movement axially of said crankshaft between said positions thereof engaging said hub or said driven member.

3. The improvement as claimed in claim 2, wherein said coupling comprises an axially slidable collar on said crankshaft having means interconnecting the collar and the hub in said first position, and interconnecting the collar and the driven member in said second position.

4. The improvement as claimed in claim 1, wherein said handle is on an end of said crankshaft, and said improvement further comprising a second handle on an opposite end of said crankshaft, a second selectively operable coupling rotatable with said crankshaft and movable between a manual operation position engaging said second handle for joining the second handle to the crankshaft, and a motorized operation position out of engagement with said second handle to release it from the crankshaft during motorized operation of the winch.

5. The improvement as claimed in claim 1, wherein said drive means has a drive ratio reducing the speed of the crankshaft relative to the drive shaft.

6. The improvement as claimed in claim 1, wherein said control circuit includes a key operated switch for controlling the application of electric current to the on/off switch means and the reversing switch means.

7. The improvement as claimed in claim 1, further comprising means for mounting said motor unit on the support section below the winch, and a housing on the support section enclosing the winch, motor unit and drive means.

8. The improvement as claimed in claim 7, wherein said housing has an access door movable between closed and open positions, and a control panel in the housing accessible when the door is open, said on/off switch means and said reversing switch means being mounted on said panel.

* * * * *